US010818994B2

(12) United States Patent
Erskine et al.

(10) Patent No.: US 10,818,994 B2
(45) Date of Patent: Oct. 27, 2020

(54) MICROWAVE GUIDE

(71) Applicant: EMS Waves Limited, Fenton (GB)

(72) Inventors: William Robertson Cunningham Erskine, Aberdeen (GB); Kristian Terah Gough, Macclesfield (GB); Andy Terah Gough, Newcastle-under-Lyme (GB); David Wilson, Aberdeen (GB); Nathan Erskine, London (GB)

( * ) Notice: Subject to any disclaimer, the term of this patent is extended or adjusted under 35 U.S.C. 154(b) by 967 days.

(21) Appl. No.: 14/893,793

(22) PCT Filed: May 23, 2014

(86) PCT No.: PCT/GB2014/051600
§ 371 (c)(1),
(2) Date: Nov. 24, 2015

(87) PCT Pub. No.: WO2014/188218
PCT Pub. Date: Nov. 27, 2014

(65) Prior Publication Data

US 2016/0126611 A1 May 5, 2016

(30) Foreign Application Priority Data

May 24, 2013 (GB) ..... 1309428.9

(51) Int. Cl.
*H05B 6/70* (2006.01)
*H01P 3/14* (2006.01)
*H01P 3/18* (2006.01)

(52) U.S. Cl.
CPC ..... *H01P 3/14* (2013.01); *H01P 3/18* (2013.01); *H05B 6/707* (2013.01); *H05B 6/708* (2013.01); *H05B 2206/046* (2013.01)

(58) Field of Classification Search
CPC .. H01P 3/14; H01P 3/18; H05B 6/707; H05B 6/708; H05B 2206/046
(Continued)

(56) References Cited

U.S. PATENT DOCUMENTS

2003/0038691 A1 2/2003 Fiedziuszko et al.
2006/0151485 A1* 7/2006 Cronin ..... A61B 18/18 219/690
2010/0139690 A1* 6/2010 Gaus ..... A47L 15/0013 134/1

FOREIGN PATENT DOCUMENTS

EP 2363913 A1 9/2011
GB 579876 A 8/1946
(Continued)

OTHER PUBLICATIONS

John Crockitt, Search Report, dated Nov. 13, 2013, 2 pages.
(Continued)

*Primary Examiner* — Quang T Van
(74) *Attorney, Agent, or Firm* — Walter Haverfield LLP; James J. Pingor

(57) ABSTRACT

A microwave guide suitable for carrying microwaves between an object that is vibrating that is connected to a first end of the guide and an object connected to the other end of the guide that is to be protected from transmitted vibrations, the guide providing a restricted path for the transmission of vibrations. In one embodiment, the guide has a flexible mesh part having an inner surface which has high electric conductivity and is provided with a plurality openings. The openings may be sufficiently small such that microwave radiation is unable to pass through the opening. The guide may also include a support structure which extends along the length of the guide. The support structure may have a low
(Continued)

dielectric loss tangent and may be sufficiently rigid to provide support to the mesh part.

20 Claims, 7 Drawing Sheets

(58) Field of Classification Search
USPC ..... 219/690, 687, 738, 692, 697, 686, 702, 219/688, 679; 333/241, 242, 239, 240, 333/248, 252; 34/259; 601/2; 385/4, 385/17, 6, 8, 14, 16, 136, 137, 129
See application file for complete search history.

(56) References Cited

FOREIGN PATENT DOCUMENTS

| | | | |
|---|---|---|---|
| GB | 2477197 | A | 7/2011 |
| JP | 08195605 | A | 7/1996 |
| WO | 8703865 | A1 | 7/1987 |
| WO | 2007002923 | A1 | 1/2007 |
| WO | 2010073013 | A2 | 7/2010 |
| WO | 2011107523 | A1 | 9/2011 |
| WO | 2014188218 | A1 | 11/2014 |

OTHER PUBLICATIONS

Ausra Kaveckaite, Notification of Transmittal of the International Search Report and the Written Opinion of the International Searching Authority, or the Declaration, dated Nov. 11, 2014, 9 pages.

* cited by examiner

MICROWAVE GUIDE

This invention relates to microwave guides for use in carrying microwaves emitted from a microwave source to or from a body which is vibrating, and to a combination of a receptacle and a connector. It especially relates to launching microwaves into a container of feedstock so as to heat and/or treat the feedstock. It is particularly suited to launching microwaves into a container that is vibrating.

It is known to use microwaves as a source of heating and/or treating a feedstock, which may be solids, liquids, gases, slurries, suspensions, emulsions or any one of a wide range of other feedstock types. The feedstock placed in a suitable container to restrain it, microwaves are generated using a magnetron and the microwaves are then directed from the magnetron into the container using a waveguide. The shape and position of the waveguide opening(s) relative to the container determines how the microwaves are distributed within the container, and so determine how the feedstock is heated.

It is well known that launching single frequencies of microwaves into a container of static feedstock, in the absence of a mode stirrer or similar assembly, does not produce uniform heating of the feedstock. To ensure uniform heating the feedstock should be moved relative to the microwave field so that different portions of the feedstock are exposed to the microwaves in turn. In a domestic microwave oven, for example, the feedstock—usually a food item or beverage—can be moved by placing the container on a rotating platform. On a larger industrial scale feedstock may be placed on a belt which is moved through the microwave field so that different parts of the feedstock are exposed over time.

In industrial applications, where large quantities of feedstock are to be heated and/or treated, it is also known to vibrate the container or to rotate it. The vibration or rotation agitates the feedstock, mixing it up and this ensures improved heating and/or treating as the parts of the feedstock move around relative to the waveguide opening(s) and also relative to other parts of the feedstock. Without this movement the feedstock may settle and be heated and/or treated unevenly creating "hot spots" which may, with certain feedstocks, result in "thermal runaway" as a positive feedback mechanism develops.

Unfortunately, the action of vibrating the container also causes any waveguide secured to the container to vibrate and this will in turn cause the microwave source to vibrate. Because microwaves sources are relatively delicate and expensive devices, the use of microwaves and vibration of a container has therefore been limited in the past.

It is an object of the present invention to ameliorate, at least partially, some of the difficulties with using microwave energy to heat/treat a feedstock in a container that is being moved, in particular one which is being vibrated.

According to a first aspect the invention provides a microwave guide suitable for carrying microwaves between an object that is to be at least partially isolated from vibrations and that is connected to a first end of the guide and an object that is vibrating that is connected to the other end of the guide, the guide providing a restricted path for the transmission of vibrations to the first end of the guide from the second end of the guide, the guide comprising:

a flexible mesh part having an inner surface which has high electric conductivity and is provided with a plurality openings, each opening being sufficiently small that microwave radiation is unable to pass through, and a support structure which extends along the length of the guide and which has a low dielectric loss tangent and which is sufficiently rigid to provide support to the mesh part, in which the mesh part comprises a braided, woven, knitted or otherwise interlaced material (textile), which in use flexes as the threads of the material slide over one another, or move relative to one another.

The guide of the invention provides a channel, or conduit, or sleeve, through which microwave energy can be passed from one object that is a source of microwave energy to another which is to be supplied by microwave energy. The guide limits the passage of vibrations along the guide so that vibration of one object is not transmitted to the other, allowing the guide to be used to connect a vibrating object to an object, such as a microwave source, that may be damaged by such vibrations.

Flexible guides are known in the art, but in the applicants opinion none are suited to use in ensuring vibration is not transmitted from one object to another because they tend to be relatively rigid. Typically they include coatings of rubber material bonded to, or impregnated into, a mesh or spring support. This bonding reduces the ability of any mesh or spring to attenuate vibration, providing a highly rigid and tough guide. Whilst this is appropriate for other applications such as telecommunications lines laid on the ocean bed, they are wholly unsuited to use in connecting a vibrating object such as a receptacle for feedstock, to a delicate source of microwaves.

The mesh part may comprise a flexible sleeve of mesh material having an inner surface which has high electric conductivity and which extends along the length of the guide, the support structure and sleeve being arranged concentrically around a common axis, the sleeve being a loose fit around the support structure.

The mesh may be free of any other supporting material so that the braids of the mesh are only constrained from movement by adjacent braids of the mesh for at least a portion of the length of the guide. They may be unconstrained everywhere apart from the ends of the guide, but may also be constrained at one or more spaced locations along the length of the guide.

The sleeve may have a uniform diameter along its length from one end of the guide to the other.

The guide may further comprise a second flexible mesh part having an inner surface which has high electric conductivity and is provided with a plurality openings, each opening being sufficiently small that microwave radiation is unable to pass through, the second mesh being located outside of the first mesh part. It may also comprise a second flexible support structure which extends along the length of the guide outside of the first mesh part and inside of the second mesh part. The second mesh part may be provided with a plurality of openings, each opening being sufficiently small that microwave radiation is unable to pass through.

Alternatively, the mesh part and support structure may comprise a composite structure in which the mesh part is integral to and coaxial with the support structure. For instance, the support structure may be woven or braided into the mesh to form a tube or sleeve. It may comprise a rigid thread or braid that forms a spring, the mesh being relatively less rigid than the spring.

The support structure may comprise a spring which extends along the length of the guide inside of the sleeve and which has a low dielectric loss tangent and which is sufficiently rigid to provide support to an inner surface of the guide that has high electric conductivity in which the sleeve comprises a braided, woven, knitted or otherwise interlaced material (textile), which in use flexes as the threads of the material slide over one another, or move relative to one another and in which the sleeve and support structure are arranged concentrically around a common axis, the sleeve being a loose fit around the support structure.

The spring may have a uniform diameter along its length. This may be slightly less than the diameter of the mesh sleeve.

The microwave guide may consist of only one flexible sleeve wherein the composition of the braided, woven, knitted or otherwise interlaced material maintains the integrity of its inner surface as a high electric conductive guide or wherein the braided, woven, knitted or otherwise interlaced material may be attached to a flexible support the composite inner surface of which forms a high electric conductive surface. By this we mean that it preferably maintains the inner diameter and/or outer diameter of the guide.

By providing support to an inner surface of the guide we mean that the support prevents significant deformation of the inner surface so that the surface remains smooth and unfolded and uncreased. Folds or creases may introduce undesirable reflections back along the guide and diminish the integrity of the waveguide. The invention therefore removes or substantially reduces the transmission of vibration by the textile along with providing a substantially smooth inner surface to ensure good forward transmission of the microwaves.

The inner surface of the guide may comprise an inner wall of the flexible sleeve.

The guide may further comprise:

a flexible outer support structure which extends along the length of the guide outside of the inner sleeve, and a flexible outer sleeve which extends along the length of the guide outside of the outer support structure and is provided with a plurality of openings, each opening being sufficiently small that microwave radiation is unable to pass through.

The outer sleeve may comprise a mesh comprising a braided, woven, knitted or otherwise interlaced material (textile) which in use flexes as the threads of the material slide over one another, or move relative to one another and which may have high electric conductive surfaces. It may be a relatively lightweight material that would not retain a tubular shape without the additional support provided by the support structure.

Thus, both the inner and outer sleeves substantially prevent the transmission of vibrations. The material may be arranged so that at least some, and preferably substantially all, of the braids are free to slide relative to one another where they cross, and as such are not restrained by glue or any other coating material which would reduced the ability of the braids to flex.

In an ideal configuration, the direction of the wires in the braids would pass in the same direction as the wall currents in a non-ideal waveguide. Thus, in an ideal waveguide transmitting in a $TE_{0m}$ mode, the braids would have a purely circumferential structure. In practice, it is recognised that such a configuration may be difficult to create whilst retaining the property of non-transmission of mechanical vibrations in the assembly.

The guide may be of any length, but to minimise reflections would ideally be (2n+1)/4 guide wavelengths long, where "n" is a whole number. A length of at least 300 mm or at least 500 mm is preferred. The longer length helps to improve the non-transmission of vibrational energy. Of course, shorter and longer lengths are possible with the scope of the invention.

As mentioned, the cross section and internal dimensions of the guide, the material used and the construction used may be chosen to minimise the attenuation of microwaves carried along the guide. This can be achieved because the mesh is held without creasing by the support, so there are no reflective surfaces presented to the microwaves that would send them back along the guide. Also, choosing a material for the support that is "transparent" to the microwaves ensures that the mesh part presents the uniform inside wall of the guide.

For example, the inside wall may have a circular cross section along the length of the guide with a diameter of the guide of 79 mm for use in carrying microwaves of 2.45 Ghz. Other diameters would be chosen for carrying microwaves of other frequencies, as would be appreciated by the person skilled in the art of microwave guides.

Providing two sleeves provides a high level of safety so that in the event of one sleeve becoming damaged the microwaves that may pass through the site of the damage are constrained by the other sleeve. The sleeves are separated by a support structure which most preferably is of a low friction material and is not tightly pressed against or otherwise adhered to the sleeves. Indeed, it is preferred that there is a gap between the sleeves and the outer support structure which may extend over the whole surface of the sleeves.

The support structure may be spaced apart from its associated sleeve. For example, the inner sleeve may be spaced apart from the inner support sleeve, and likewise the outer sleeve from the outer support structure. Similarly, where inner and outer sleeves/support structures are provided they may all be spaced apart so that they do not contact each other.

Alternatively, they may be loosely in contact along at least a part of their length.

The textile material may be knitted, woven, braided or otherwise interlaced into a seamless tube. It may comprise multiple braids of threads, the braids being woven into a seamless tube.

The material may have coverage of at least 95 percent, or at least 97 percent, or 100 percent to prevent significant leakage of microwave energy through the walls of the waveguide. Coverage refers to the ratio of threads to gaps between the threads, which typically arise where they cross over in the weaving or braiding pattern due to the need for the threads to bend in those regions.

The material of the first and second sleeves, or one of the sleeves, may comprise a sheet textile material that is substantially two dimensional. It may comprise a woven material in which electrically conductive threads are arranged in groups that intersect at an angle of between 60 degrees and 90 degrees to each other, passing alternately over and under other threads. It may comprise a continuous sheet of material.

The material of the first and second sleeves, or one of the sleeves, may comprise a braided material in which the threads are crossed so that some or all of the threads extend in a direction that is neither parallel to or orthogonal to the long axis of the sleeve. A suitable pattern would be a herringbone pattern.

The threads of the material may comprise metallic threads, or may comprise non-metallic threads with a metallic coating or may comprise a composite non metallic and metallic content. For instance it may comprise a material that contains metallic particles, or a combination of metallic and non-metallic particles.

The threads may comprise tinned copper wires, they may have typical diameters of between (0.2 mm and 3.0 mm); the braids may comprise at least two threads or as many as 60 threads. There could be more than 60 threads. The threads may comprise flat wire or tape.

The inner support structures may comprise at least one helical spring. In addition to helping prevent the inner sleeve collapsing, the spring helps reduce the transmission of vibrations when the guide is flexed.

The inner support structure may comprise a PTFE structure or other material that displays a low dielectric loss tangent at microwave frequencies. This ensures that the support does not present any reflective surfaces to the microwaves that would perhaps cause microwaves to be reflected back along the guide. The microwaves are contained within the inner sleeve as the wall of the guide, and their transmission is largely unaffected by the presence of the PTFE support material. The inner support structure may comprise an electrically conductive material such as a metal spring.

The helical spring may be cut from a solid or hollow tube of PTFE material. It may have a right or left hand cut. The spacing between the adjacent turns of the spring may be between 1 mm and 5 mm and preferably 3 mm. This can be formed using a 3 mm wide cutting tool on a lathe.

The spring may have a pitch of between 40 mm and 60 mm and preferably may be 50 mm. It may have a wall thickness (the distance between the outer wall of the spring and the inner wall of between 1 mm and 10 mm, with 5 mm preferred.

The helical spring when cut from a solid or hollow tube may be provided with flanges at each end that are secured, perhaps by adhesive, after cutting.

The outer support structure may comprise a helical spring, and may comprise a PTFE spring or other material. It may comprise an electrically conductive material such as a metal spring.

Both the inner and outer support structures may comprise helical springs. The two springs may be arranged so that they form a chiral pair of either the opposite or the same senses.

Where one or more springs are used, the inner spring, the outer spring, or all springs, may be held under load by being secured to one or more end flanges 2,3 which are located at the end of the springs. The or each of the springs may be secured to the sleeves by means of a grub screw or other such fixing mechanism/s. The relative positions of the flanges should be fixed to maintain the tension in the springs.

The springs may be held under, tension, torsion or compression.

The or each spring may comprise a wound or extruded coil, or may be formed by cutting the spring shape from a solid block of material, or a tube of material, for example using a computer numerical controlled (CNC) machine.

The spring may comprise a helical slot cut into a hollow cylindrical body.

In one arrangement, the cylindrical body may be closed at one end to form a window that extends across the end of the guide. This will help ensure dust or other unwanted debris cannot enter the guide. The window may be an integral part of the spring.

A first end of the guide may be provided with a flange by which the guide can be secured to a body such as a waveguide or receptacle.

The inner member and outer support structures may be secured to the flange, and the inner and outer sleeves may be secured to the flange.

A clamping piece may be provided and the inner and outer sleeves may be secured to the flange by clamping them between the flange and the clamping piece.

Both the flange and clamping piece may be generally annular, so that the common axis around which they are arranged is an axis of rotation.

The guide may include means for adjusting the load applied to the inner and outer support structures, i.e. adjust the tension or torsion. For example, one spring may be secured to the flange and the other to the clamping piece, and means may be provided for adjusting the relative angular position of the flange and clamping piece.

The adjustment means may comprise a threaded opening in the flange or clamp piece into which a threaded nut is inserted, one of the inner and outer springs being secured to that one of the flange and clamp piece and the other spring being secured to the other of the flange and so that an end of the threaded bolt applies a thrust onto an end of the inner or outer spring according to the relative position of the bolt in the bore.

In one arrangement, a first flange may be provided that comprises a circular ring has a hole bored through the edge. This flange may be tapped to allow a M8 size grub screw with a tapered end to be fitted. Two such holes diametrically opposite one another give greater security.

When in place, a further small bolt with an anti-vibration washer 204 (such as Nordlock) may be inserted so as to stop the grub screw from loosening due to vibration.

The inside sleeve of the PTFE may have a series of shallow indents into which the grub screw is secured.

Tensioning of the PTFE spring may be adjusted by selection of indent into which the grub screw is tightened.

The inner and outer supports and inner and outer sleeves may be free to move axially relative to one another along the length of the guide apart from the points where they are secured at the flanges. They may be held so that they are spaced apart by a small distance, say up to 5 mm or so, or may be in contact with each other. However, they should not provide too much friction which may make the guide relatively rigid and so more able to transmit vibrations.

The guide may be arranged so that when there is vibration of one end at a frequency of of 50 Hz the magnitude of the vibrations at the other end will be attenuated −11 dB (minus 11 decibels).

The guide may have a resonant frequency below 1 Hz, or below 0.5 Hz.

The guide may include an additional outer shell which comprises a continuous sleeve of material that extends along the length of the guide and which in use can be arranged to seal the outer sleeve within the shell.

The shell may comprise a flexible bellows, perhaps of rubber or neoprene.

The outer shell may be provided with at least one opening and the guide may include means for selectively obscuring the opening. The opening may be opened if required to release heat from within the guide which may build up due to friction or wall currents, and so permit the ingress and egress of a cooling air flow. and then closed as required to prevent dirt reaching the sleeve.

The means for obscuring the opening may comprise a cap, plug or may be an automatic opening/closing device such as a one way air valve.

The guide may form a microwave waveguide for any microwave frequency (300 MHz-300 GHz) but practically useful embodiments may be limited to frequencies between 300 MHz and approximately 50 GHz.

The guide of the invention therefore provides an electrically conductive tube which allows for continuous multiple rapid small deformations in the sleeves that attenuate/isolate vibrations being transmitted from one end to the other. The provision of the inner sleeve of a high electric conductive material allows a smooth wall to be presented to the microwaves passing through the guide, substantially minimising energy reflected back along the waveguide and ensuring that any wave mode variation within the selected bandwidth is acceptable for a specific application.

As already stated, the sleeves may be constructed from a variety of materials in a variety of different ways. The applicant has appreciated that desirable qualities of the material used to form the sleeve include the use of threads with a round or flat cross section; and that control is required of the number of threads per braid; the weave pattern and the orientation of the threads relative to the axis of the sleeve; and also the dimension of gaps between threads prevent microwave energy from escaping while permitting gases to vent. For instance, the gaps should not be so great that microwaves will pass through and escape from the sleeve, and this gap will depend on the wavelength of the microwaves that are to pass through the sleeve.

In one preferred arrangement, a specification of the weave of material used to form the inner and outer sleeves may be as follows:

32 SWG tinned copper wire;

40 ends of wire (thread) wound flat (braid) on each spindle;

Braided on a 60 spindle braiding machine for 100% coverage.

A variety of materials can also be used for the spring, although the applicant prefers to use PTFE as it has a number of advantageous qualities that make it suitable for use in the sleeve assembly. PTFE is an example of a dielectric whose relative dielectric constant is greater than 1, and the presence of this inside the sleeve will reduce the diameter of the waveguide required for effective transmission of microwaves. PTFE has a lubricious quality which reduces friction between the adjacent layers, helping reduce the resonant frequency of the assembly.

In an alternative, rather than using PTFE the applicant proposes that the spring could comprises a flat helical metal waveguide whose gap is covered with a braid-like structure.

According to a second aspect the invention provides a microwave launcher for launching microwaves into a vibrating object, the launcher comprising a source of microwave radiation that is to be protected from vibrations from the vibrating object, and a guide according to the first aspect that is secured at one end to the source and at the other to the vibrating object, the guide substantially preventing the transmission of vibrations from the vibrating object to the source of microwave radiations through the guide The launcher may include a fan which blows air into the end of the guide connected to the source. Because the inner and outer sleeves contain openings some of the air blown along the guide will be free to escape through the holes, cooling down the guide and helping to prevent arcing from reaching the microwave source.

The fan may be an integral component of the magnetron or it may be arranged to blow air into the inside of the inner sleeve, or into a space formed between the inner sleeve and outer sleeve where two sleeves are provided.

The fan may be arranged to blow chilled air or nitrogen into the guide.

According to a further aspect the invention provides a combination of a launcher according to the second aspect and a vibrating receptacle suitable for use in drying feedstock in the receptacle using microwave energy that has passed through the guide, the vibrating receptacle comprising a receptacle and at least one actuator that causes the receptacle to vibrate at a known frequency at which the guide provides a high degree of attenuation from one end to the other.

The actuator may comprise a motor, and the motor may cause the receptacle to vibrate at a single frequency or at two or more frequencies.

There will now be described, by way of example only, two embodiments of the present invention with reference to and as illustrated in the accompanying drawings of which:

Figure 1:
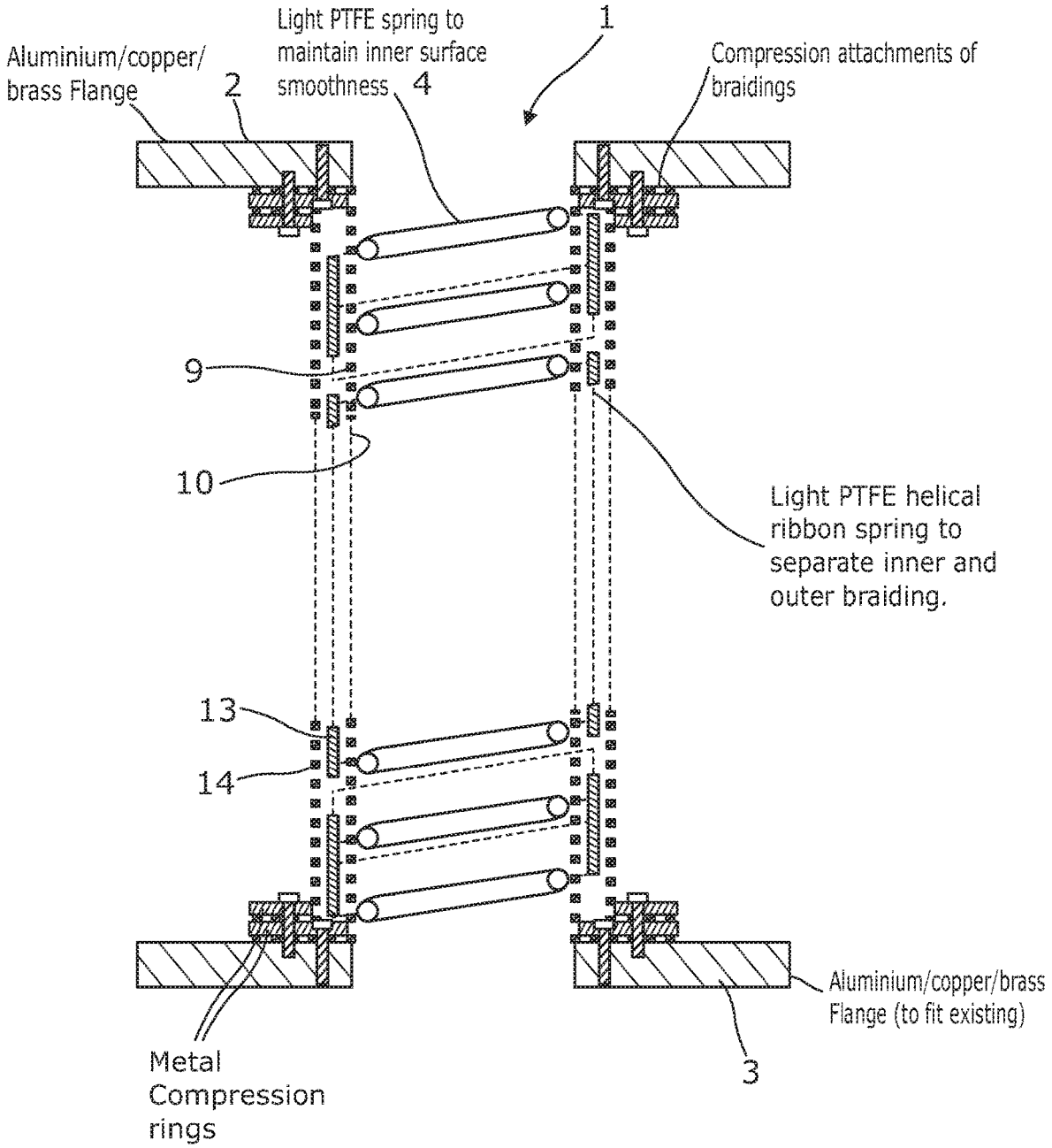
FIG. 1 is a cross section through a first embodiment of a guide in accordance with the present invention.
Figure 2:
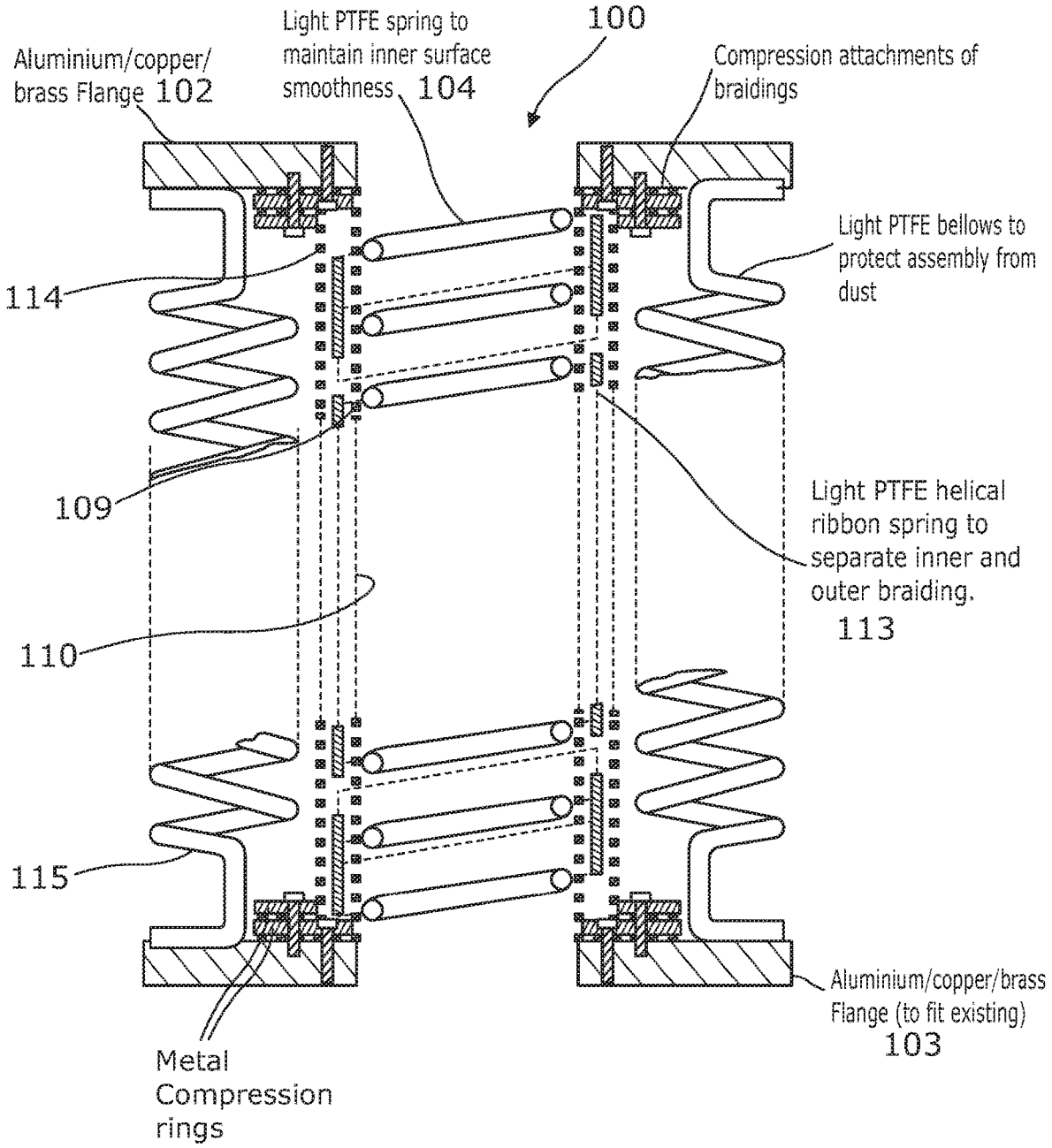
FIG. 2 is a cross section through a second embodiment of a guide in accordance with the present invention.
Figure 5:
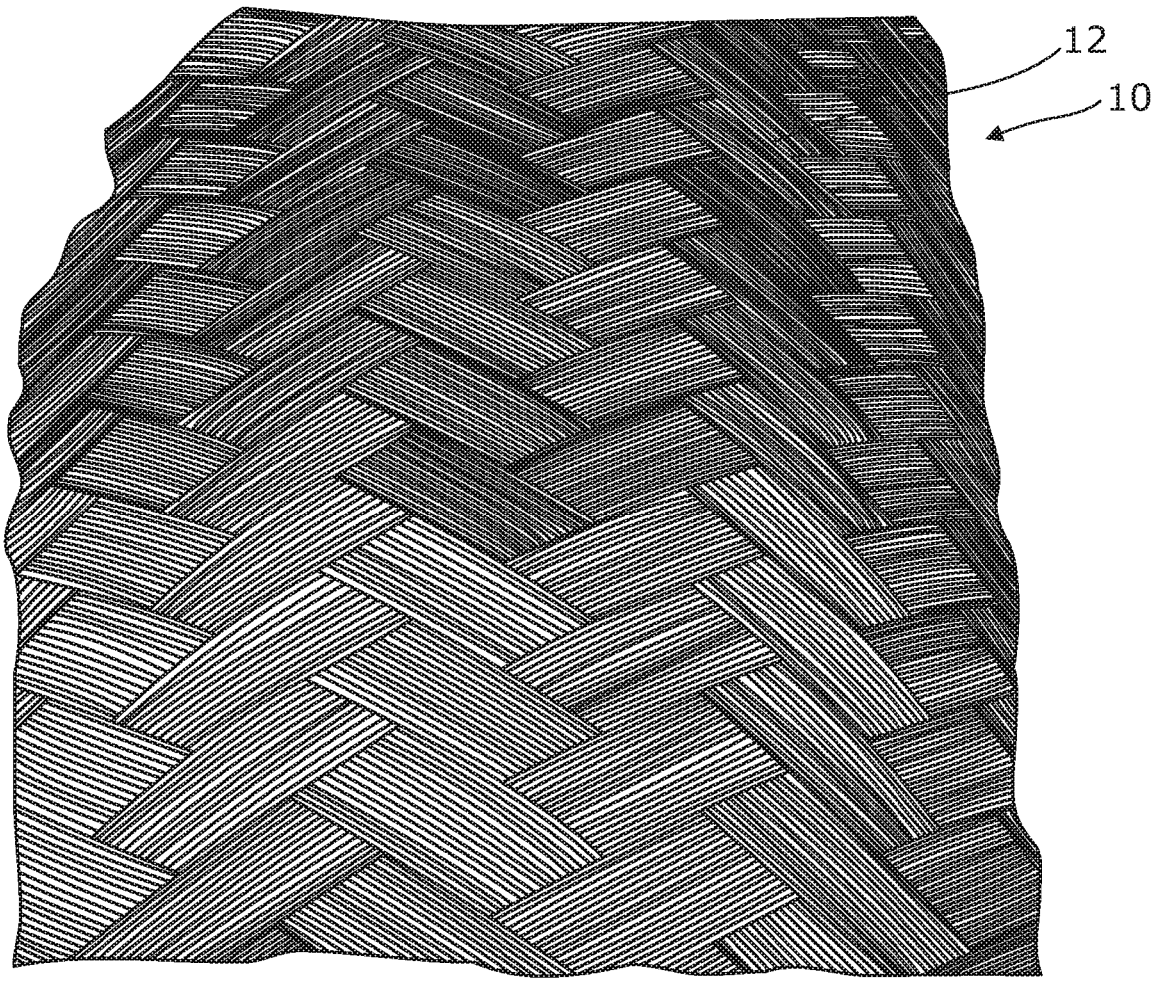
Figure 6:
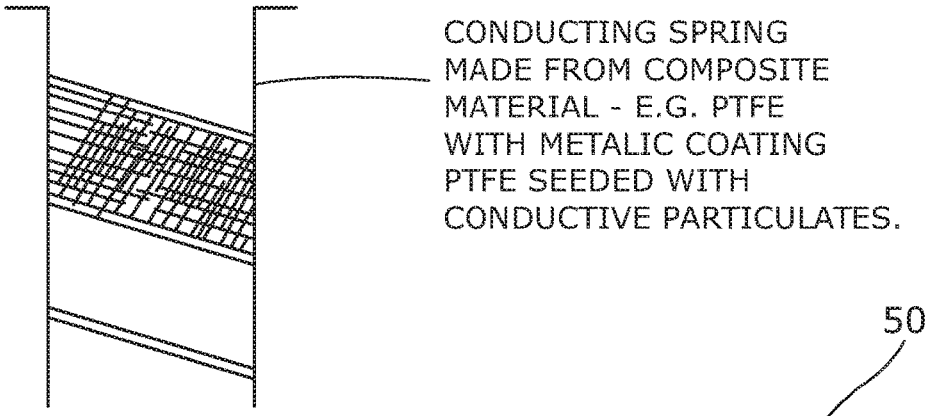
Figure 7:
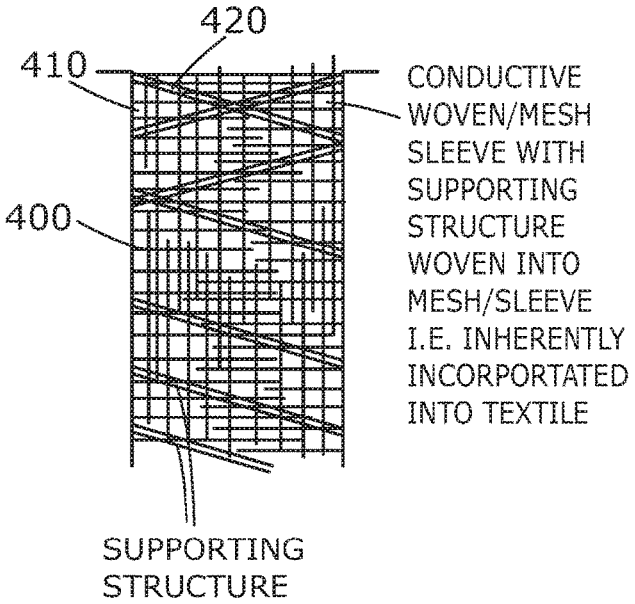
Figure 9:
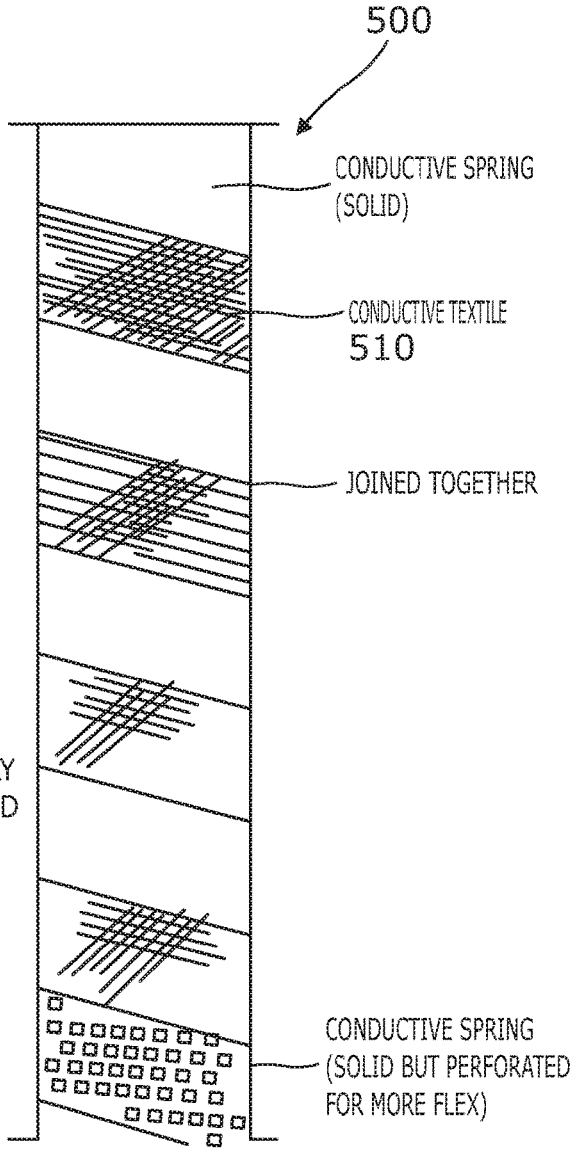
Figure 8A:
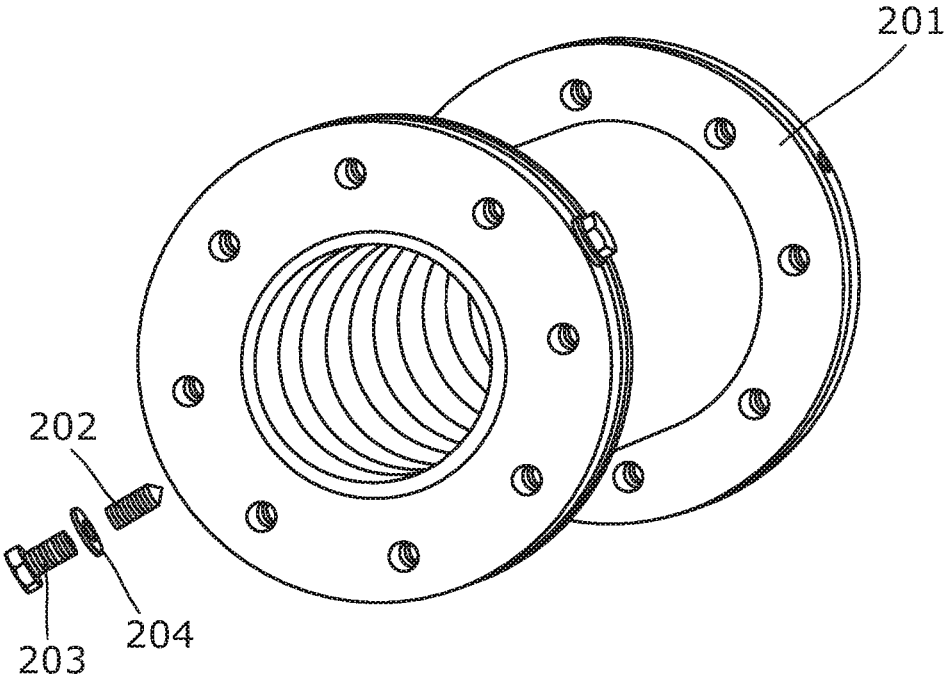
Figure 8B:
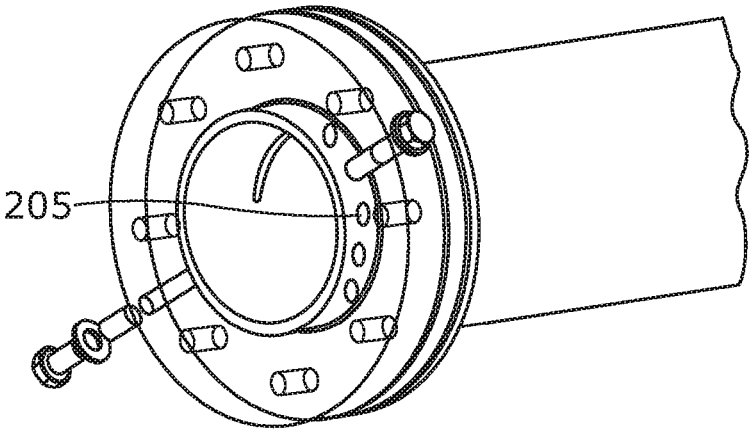

FIG. 5 is a photograph of a small section of braided material used to form a sleeve, FIG. 6 shows a modified spring that can be used within a further embodiment of a guide assembly according to the invention, FIG. 7 show an alternative combined sleeve and support structure that can be used within a guide assembly in accordance with the present invention, FIGS. 8(*a*) and (*b*) shows an arrangement for securing the PTFE spring and for adjusting the tension of the PTFE spring in the embodiment of FIG. 1 or FIG. 2; and FIG. 9 shows a still further alternative combined sleeve and support structure that can be used within an embodiment of the present invention.

A guide 1 that substantially fails to transmit mechanical vibrations comprises a flexible tubular multi-layer waveguide that is terminated at each end with a flange 2, 3. The multi-layer waveguide has an effective internal diameter equivalent to a hollow waveguide of 89 mm although this can be varied according to the wavelength of the radiation that it is intended to guide, and the guide has a sufficiently different natural frequency of resonance to that of the vibrating source that it is able to isolate substantially all of the resonant frequencies emanating from the source. A structure with a resonant frequency of 0.5 Hz is thus able to act as a non transmitting barrier to frequencies of 50 Hz.

Figure 3:
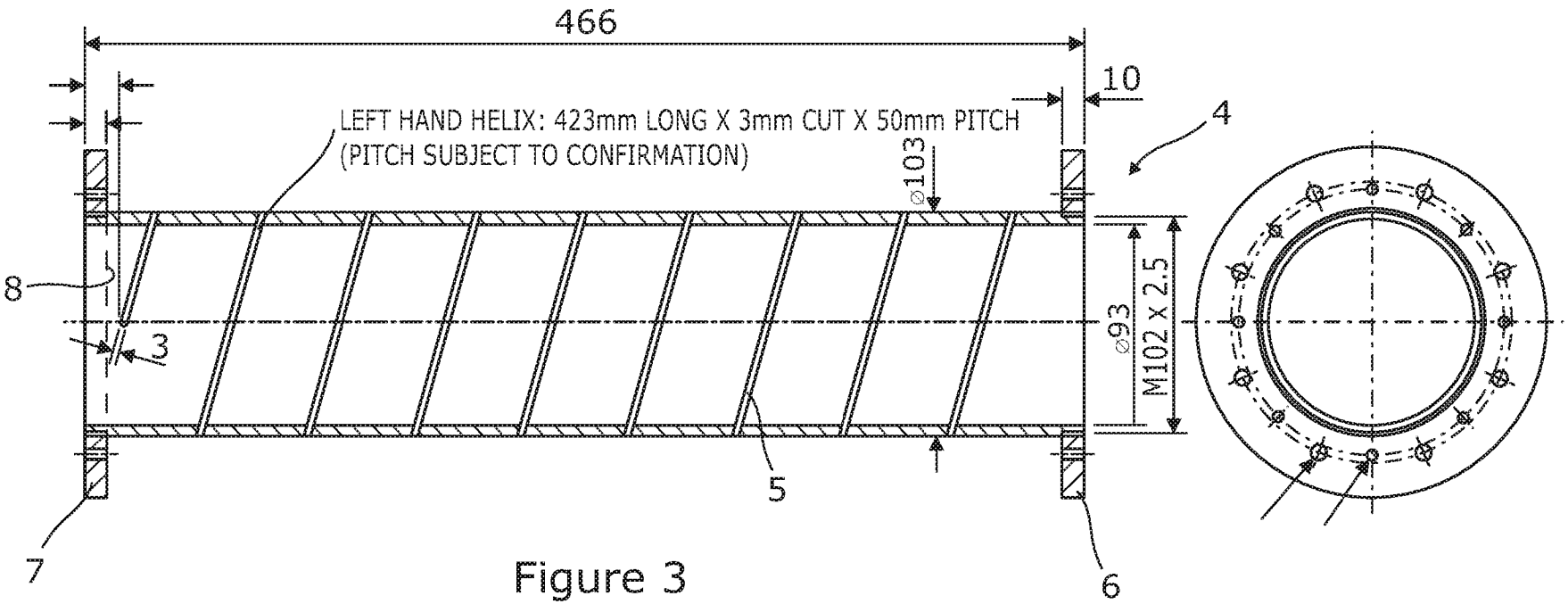
FIG. 3 is an (a) cross section and (b) end view of a flexible PTFE spring that forms a part of the guides of FIG. 1 or FIG. 2.

In its simplest form the guide shown in FIG. 1 can be considered to comprise at least one sprung section which may or may not be electrically conductive and at least one electrically conductive mesh or textile section (textile meaning a woven or knitted or braided mesh material or other interlaced structure) Material selection for both the sprung and textile sections would take in account their hysteretic (material) damping properties, the natural frequencies of resonance of the component(s) and the combined strength of their elastic and viscoelastic properties In detail the guide 1 comprises an inner support structure in the form of a helical PTFE spring 5 machined from a solid billet or extruded into a helical coil as shown. The coil has a uniform diameter along its length in this example. As shown in FIG. 6 it may be provided with a metallic coating. FIG. 3 shows a suitable spring 4 in detail, where it can be seen that a helical slot 5 is cut into the wall of a hollow cylinder that extends from one end to the other continuously. The PTFE spring 4 may be integrally formed with two collars at each end enabling the spring to be secured to the flanges 2, 3 of the guide. An optional integral end portion 8 that closes one end of the cylinder is shown in dashed line. This end portion may comprise a solid PTFE window.

The inner spring 4 is surrounded concentrically by an inner sleeve 9 of textile material comprising a woven braided copper tube. The inner wall 10 of the tubular sleeve 9 forms a continuous electrically conducting wall. The low dielectric loss PTFE is of sufficient tensile strength to substantially maintain the inner dimensions of the electrically conductive wall so that deformations of the wall which would otherwise create reflected power and/or mode variation are eliminated or minimised to an acceptable level according to the application. The manufacture of PTFE, stabilisation through sintering and machining of a compressed billet into a torsional spring is a known art. The precise choice of PTFE, the thickness of, the pitch of, and the number of coils and the number of starts in the spring are selected to achieve a flexural performance capability according to application, but the spring chosen preferably results in:

1. a sufficiently supported structure to maintain the electrically conducting properties of the inner sleeve
2. a sufficiently light and low tensioned structure to poorly transmit vibrations of frequencies generated by the source of vibration.
3. Non-transmission of vibration due to the viscoelastic (hysteretic) properties of the PTFE
4. Non-transmission of vibrations through the structure of the guide.

The woven braided copper tube 9 is preferably seamless and made up of a plurality of braids which in turn are made up of a plurality of threads (filaments, wires.tapes) of a fine gauge. The braids 10,11 formed from threads 12 are shown in FIG. 5 for a small portion of the textile material. The braids pass repeatedly under and over other braids and are tightly woven.

Weaving of continuous metal braids into a thin sheet material that can be configured as a three dimensional tubular structure is a known art and it is further known that these tubes can be used for their flexible qualities, but the weave chosen preferably results in:

1. a woven, knitted, braided or otherwise interlaced seamless tube wherein the copper wire has a sufficiently high surface coverage to contain the selected frequency of microwaves by ensuring that any gaps in the material between the threads and/or the braids at the absolute maximum limit of flexion are no bigger in diameter than a quarter of the wavelength selected to be propagated by the conducting surface.
2. A woven tube wherein the copper wire has a sufficiently high composite thickness of the electrically conductive wall that it represents many multiple "skin depth" lengths, as a minimum to prevent microwave leakage for the selected wave frequency and power
3. A woven tube wherein the direction of the woven braids follow a substantially helical path in relation to the axis of the elongate tube.
4. A sufficiently light and low tensioned structure to poorly transmit vibrations of frequencies generated by the source of vibration.

It has been found that an electrically conductive sleeve (in this instance constructed from tinned copper wire) constructed to achieve the above requirements exhibits the capability to rapidly and repeatedly flex in multiple planes simultaneously due to interfacial slip at the numerous thread/braid interfaces, and the helical paths created by braids of the weave. A weave made by one braid lying parallel to the axis of the guide and the other weave lying at a right angle to the first, is more vulnerable to transmitting vibrations than a weave which is positioned with the braids lying on the bias in relation to the axis of the guide.

The PTFE spring 4 and the woven tube 9 are secured in a spaced relationship relative to each other by means of the flanges 2, 3 at the two ends of the elongate cylindrical structure. Known means of attaching braided metal weave to flanges such as crimping, welding, brazing, soldering may be used, although in a preferred embodiment a suitably secured clamping mechanism may be used which allows for the structure to be easily disassembled and repaired.

In the first example of FIGS. 1 to 3, each flange comprises a circular ring that has a hole bored through the edge 201. This is then tapped to allow a M8 size grub screw 202 with a tapered end to be fitted. Two such holes diametrically opposite one another give greater security.

When in place, a further small bolt 203 with an anti-vibration washer 204 (such as Nordlock) is inserted so as to stop the grub screw from loosening due to vibration. The inside sleeve of the PTFE has a series of shallow indents into which the grub screw is secured. Tensioning of the PTFE spring may be adjusted by selection of indent into which the grub screw is tightened.

Figure 4:
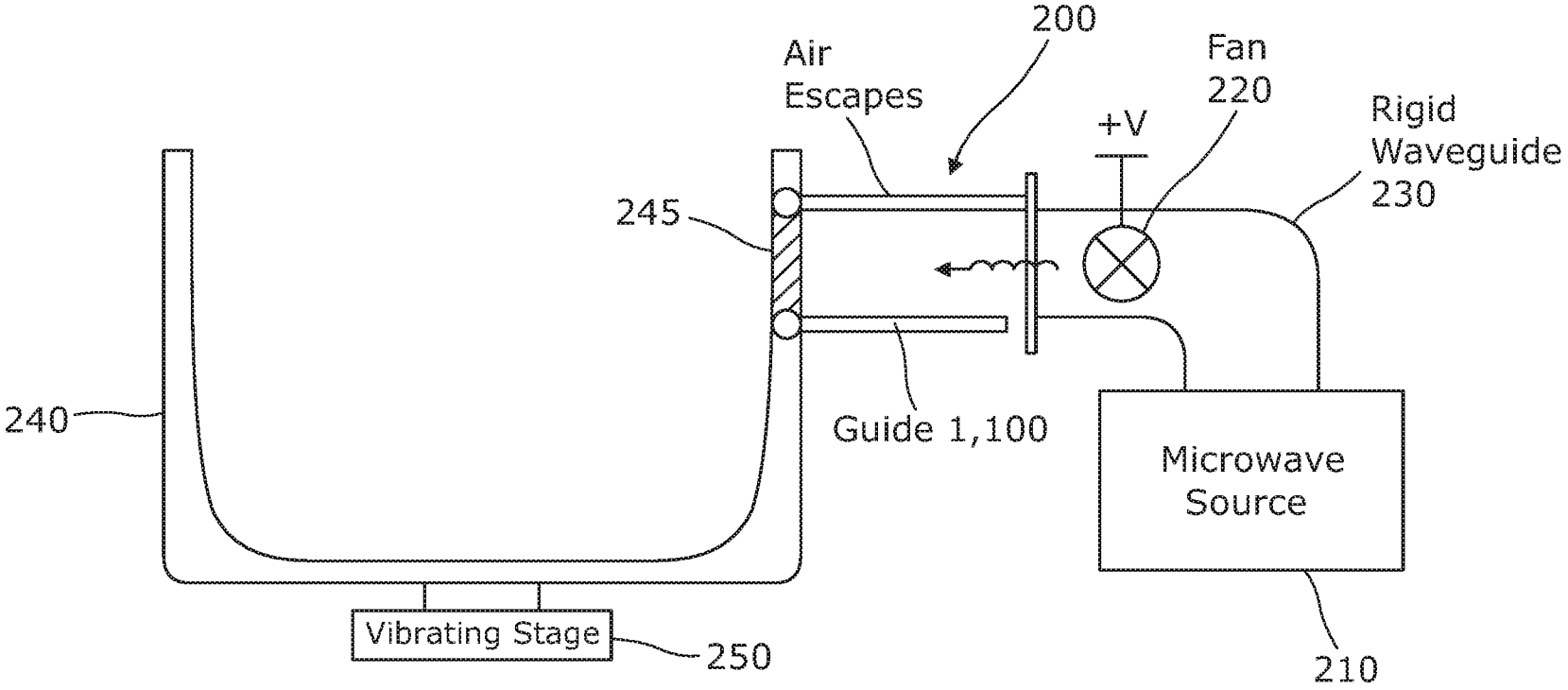
FIG. 4 shows a launcher connected to a vibrating receptacle for feedstock, the launcher including a guide as shown in FIG. 1 or FIG. 2.

It has been found experimentally in trials where this structure has been coupled to a vibrating item of processing machinery or other object, typically a container such as a trough, as shown in FIG. 4, that preferably the assembled structure comprises a second support structure comprising an outer support structure forming a spring 13. In this example, the spring is of the same material as the first PTFE spring 4 but of a sufficiently greater diameter that it can concentrically surround the first inner sleeve in a spaced relationship with the coil of the spring following an opposite helical path to that described by the first spring.

Additionally, an outer sleeve of textile material comprising a second braided woven tube 14 is provided which may or may not be of the same material as the first braided woven tube but of a sufficiently greater diameter than the first braided woven tube so that it can concentrically surround the second spring 13 in a spaced relationship, the second spring and second sleeve being similarly attached to the two end flanges 2, 3.

The flange holds the two springs in balanced torsion, maintaining the optimum degree of rigidity required to support the inner sleeve yet retaining sufficient flexibility to poorly transmit vibration from the vibrating source.

This composite structure has been found to function as a vibration non-transmitting system in a dynamic environment. It is thought that this results from operating the vibrating unit at frequencies that are substantially different from the natural mechanical vibrational frequencies of the waveguide assembly . . . .

In this embodiment it is notable that the two sleeves 9, 14 are separated from contact with one another by a PTFE component and an additional characteristic of the second braided tube is that it provides enhanced protection from any leakage of microwaves from the inner sleeve guide.

An alternative embodiment of a guide 100 is shown in FIG. 2 of the drawings. In this embodiment, the components which are the same as those of the first embodiment are marked using the same reference numerals for clarity but increased by one hundred.

The guide 100 includes an additional outer concentric component that comprises a flexible washable membrane 115 which prevents dust and oil particles in the external environment from becoming entrapped within the braided woven weave. In this embodiment a light PTFE bellows had been chosen. The bellow should not be so rigid as to prevent the sleeves deforming under vibration, as it would otherwise transmit from one end of the guide to the other.

The guides 1, 100 may be used to launch microwave energy into a vibrating receptacle. For instance, the energy may be used in a launcher 200 to heat feedstock in the receptacle.

In such an arrangement, as shown in FIG. 4 a launcher 200 is secured to a wall of a container 240. The container 240 is provided with a window 245 of material which is transparent to microwaves, and is aligned with one end of the guide 1,100 of the launcher 200. The flange 2,102 at the first end of the guide part is secured to the container 240 around the window and the flange at the other end 3,103 is secured to a rigid waveguide 230 which in turn is fixed to a source of microwaves 210.

The container 240 is supported on a vibration stage 250 such as a bed (not shown) which is connected to a motor that upon rotation causes the container to vibrate. This vibration causes the guide to vibrate, but the guide isolates this vibration rather than transmitting into to the rigid waveguide 230 and so little vibrational energy is transmitted to the microwave source. This ensures the microwave source 210 is protected from damage that may otherwise be caused by vibration of the container.

Also shown in FIG. 4 is a fan 220 which forms part of the launcher 200, the fan blows air from the rigid waveguide 230 (or from outside) into the guide 1,100. This air can pass along the guide and may escape through the gaps between the braids and individual threads of the sleeves. The air helps cool the inside of the guide, and also helps to prevent arcs that may be produced inside the guide. This is especially useful where there may be moisture in the guide on first firing up the microwave source which could produce arcs.

In a modification, shown in FIG. 7 a sleeve 400 can be provided which is formed from a mesh of material that is woven or braided, with a supporting structure 420 that is integrated into the material. This supporting structure may be woven into the material to form a helical spring, perhaps using heavier gauge wire compared with the gauge of the rest of the mesh.

In another alternative shown in FIG. 9, a spring 500 may be provided which is similar to the PTFE spring of FIG. 3 but which has mesh material 510 between the windings to prevent microwaves escaping through the spring. Again, this effectively combines the support structure and the sleeve in one element. As shown, the solid strip of the spring may be perforated to increase its flexibility. This feature could be used in the embodiments of FIGS. 1 and 2.

In a modification to the invention, the guide may be provided that has a smaller internal diameter for a given microwave frequency so that it functions as a choke, the guide providing a means by which fluids (such as air) and/or solids can pass from one object to another whilst preventing the passage of microwaves, the guide absorbing vibrations to prevent them passing unattenuated along the guide.

The invention claimed is:

1. A microwave guide suitable for carrying microwaves between an object that is to be at least partially isolated from vibrations and that is connected to a first end of the microwave guide and an object that is vibrating that is connected to a second end of the microwave guide, the microwave guide providing a restricted path for the transmission of vibrations to the first end of the microwave guide from the second end of the microwave guide, the microwave guide comprising:

a first flexible mesh part having an inner surface which has high electric conductivity and is provided with a plurality openings, each opening being sufficiently small that microwave radiation is unable to pass through, wherein the first flexible mesh part comprises a first flexible sleeve that extends along the length of the microwave guide, the first flexible support structure and first flexible sleeve being arranged concentrically around a common axis, and the first flexible sleeve being a loose fit around the first support structure; and a first flexible support structure which extends along a length of the microwave guide and which has a low dielectric loss tangent and which is sufficiently rigid to provide support to the first flexible mesh part, in which the first flexible mesh part comprises a braided, woven, knitted or otherwise interlaced material, which in use flexes as threads of the interlaced material slide over one another, or move relative to one another;

a second flexible mesh part having an inner surface which has high electric conductivity and is provided with a plurality openings, each opening being sufficiently small that microwave radiation is unable to pass through, the second flexible mesh part being located outside of the first flexible mesh part; and a second flexible support structure which extends along the length of the microwave guide outside of the first flexible mesh part and inside of the second flexible mesh part and is provided with a plurality of openings, each opening being sufficiently small that microwave radiation is unable to pass through.

2. The microwave guide according to claim 1, wherein the microwave guide comprises only the first flexible sleeve.

3. The microwave guide according to claim 1, wherein an inner wall of the first flexible sleeve forms an inner wall of the guide microwave that the microwaves cannot pass through.

4. The microwave guide according to claim 1, wherein an outer sleeve and the inner mesh part each comprise a braided, woven, knitted or otherwise interlaced material which in use flexes as the threads of the interlaced material slide over one another, or move relative to one another and which may have high electric conductive surfaces.

5. The microwave guide according to claim 1, wherein the length of the microwave guide is (2n+1)/4 times a wavelength of microwave energy that is to be passed along the microwave guide when in use, where "n" is a whole number.

6. The microwave guide according to of claim 1, wherein the material of the first flexible mesh part is knitted, woven, braided or otherwise interlaced into a seamless tube.

7. The microwave guide according to claim 1, wherein the second flexible mesh part is knitted, woven, braided or otherwise interlaced into a seamless tube.

8. The microwave guide according to claim 7, wherein the material of one or both of the first flexible mesh part and the second flexible mesh part comprises a braided material in which threads are crossed so that some or all of the threads extend in a direction that is neither parallel to or orthogonal to the long axis of the sleeve.

9. The microwave guide according to claim 1, wherein the first flexible mesh part and first flexible support structure comprise a composite structure in which the first flexible mesh part is integral to and coaxial with the first support structure.

10. The microwave guide according to claim 1, wherein at least one of the first flexible support structure or second flexible support structure comprises at least one helical spring.

11. The microwave guide according to claim 10, wherein the first flexible support structure comprises a spring, such as a PTFE structure or other material that displays a low dielectric loss tangent at microwave frequencies.

12. The microwave guide according to claim 10, wherein the first flexible support structure is held under a load by being secured to one or more end flanges which are located at the end of the microwave guide.

13. The microwave guide according to claim 12, wherein the load is adjustable to vary the tension of the first flexible support structure.

14. The microwave guide according to claim 1, wherein when there is vibration of one end of the microwave guide at a frequency of 50 Hz the magnitude of the vibrations at the other end of the microwave guide will be attenuated by at least −11 dB (minus 11 decibels).

15. The microwave guide according to claim 1 further comprising an additional outer shell having a continuous sleeve of material that extends along the length of the microwave guide and which in use can be arranged to seal the first flexible mesh part within the shell.

16. The microwave guide according to claim 15, wherein the shell comprises a flexible bellows.

17. The microwave guide according to claim 1, wherein a launcher for launching microwaves into a vibrating object is provided, the launcher comprising a source of microwave radiation that is to be protected from vibrations from the vibrating object, and wherein the microwave guide is secured at one end to the source and at the other to the vibrating object, the microwave guide substantially preventing the transmission of vibrations from the vibrating object to the source of microwave radiations through the guide.

18. The microwave guide according to claim 17, wherein the microwave launcher includes a fan which blows air into the end of the guide connected to the source.

19. The microwave guide according to claim 17, wherein a vibrating receptacle suitable for use in drying feedstock in the receptacle using microwave energy that has passed through the microwave guide is provided, wherein the vibrating receptacle includes a receptacle and at least one actuator that causes the receptacle to vibrate at a known frequency at which the microwave guide provides a high degree of attenuation from one end to the other.

20. A microwave guide suitable for carrying microwaves between an object that is to be at least partially isolated from vibrations and that is connected to a first end of the microwave guide and an object that is vibrating that is connected to a second end of the microwave guide, the microwave guide providing a restricted path for the transmission of vibrations to the first end of the microwave guide from the second end of the microwave guide, the microwave guide comprising:

a first flexible mesh part having an inner surface which has high electric conductivity and is provided with a plurality openings, each opening being sufficiently small that microwave radiation is unable to pass through, wherein the first flexible mesh part comprises a first flexible sleeve that extends along the length of the microwave guide, the first flexible support structure and first flexible sleeve being arranged concentrically around a common axis, and the first flexible sleeve being a loose fit around the first support structure; and a first flexible support structure which extends along a length of the microwave guide and which has a low dielectric loss tangent and which is sufficiently rigid to provide support to the first flexible mesh part, in which the first flexible mesh part comprises a braided, woven, knitted or otherwise interlaced material, which in use flexes as threads of the interlaced material slide over one another, or move relative to one another;

a second flexible mesh part having an inner surface which has high electric conductivity and is provided with a plurality openings, each opening being sufficiently small that microwave radiation is unable to pass through, the second flexible mesh part being located outside of the first flexible mesh part; and a second flexible support structure which extends along the length of the microwave guide outside of the first flexible mesh part and inside of the second flexible mesh part and is provided with a plurality of openings, each opening being sufficiently small that microwave radiation is unable to pass through, wherein an outer sleeve and the inner mesh part each comprise a braided, woven, knitted or otherwise interlaced material which in use flexes as the threads of the interlaced material slide over one another, or move relative to one another and which may have high electric conductive surfaces, and wherein at least one of the first flexible support structure or second flexible support structure comprises at least one helical spring.

* * * * *